US010141083B2

(12) United States Patent
Hsiao et al.

(10) Patent No.: US 10,141,083 B2
(45) Date of Patent: Nov. 27, 2018

(54) TRANSPARENT CONDUCTIVE FILM COMPOSITE AND TRANSPARENT CONDUCTIVE FILM

(71) Applicant: INDUSTRIAL TECHNOLOGY RESEARCH INSTITUTE, Hsinchu (TW)

(72) Inventors: Wei-Han Hsiao, New Taipei (TW); Chun-Yi Chiu, Hsinchu (TW); Kuo-Chan Chiou, Tainan (TW); Tzong-Ming Lee, Hsinchu (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 316 days.

(21) Appl. No.: 14/582,555

(22) Filed: Dec. 24, 2014

(65) Prior Publication Data

US 2015/0187455 A1 Jul. 2, 2015

(30) Foreign Application Priority Data

Dec. 30, 2013 (TW) ..... 102148966 A

(51) Int. Cl.
*H01B 1/02* (2006.01)
*H01B 1/22* (2006.01)

(52) U.S. Cl.
CPC ..... *H01B 1/22* (2013.01); *H01B 1/02* (2013.01)

(58) Field of Classification Search
CPC ..... H01B 1/02
See application file for complete search history.

(56) References Cited

U.S. PATENT DOCUMENTS

| | | | |
|---|---|---|---|
| 6,143,418 | A | 11/2000 | Takamiya et al. |
| 6,524,499 | B1 | 2/2003 | Takamiya et al. |
| 7,341,680 | B2 | 3/2008 | Pan et al. |
| 2006/0197064 | A1 | 9/2006 | Pan et al. |
| 2010/0209690 | A1 | 8/2010 | Sang et al. |
| 2010/0288531 | A1 | 11/2010 | Koyama et al. |
| 2011/0174190 | A1 | 7/2011 | Sepa et al. |
| 2011/0285019 | A1 | 11/2011 | Alden et al. |
| 2013/0037094 | A1 | 2/2013 | Wang et al. |

(Continued)

FOREIGN PATENT DOCUMENTS

| | | | |
|---|---|---|---|
| EP | 1947702 | A2 | 7/2008 |
| EP | 2251389 | A1 | 11/2010 |

(Continued)

OTHER PUBLICATIONS

Chinese Office Action and Search Report for Chinese Application No. 201410338662.7, dated Mar. 31, 2016.

(Continued)

*Primary Examiner* — William D Young
(74) *Attorney, Agent, or Firm* — Birch, Stewart, Kolasch & Birch, LLP

(57) ABSTRACT

A transparent conductive film composite is provided. The transparent conductive film composite includes (a) 0.07-0.2 wt % of a metallic material; (b) 0.01-0.5 wt % of a dispersant; and 99.3-99.92 wt % of a solvent, wherein the metallic material (a) includes: (a1) 84-99.99 wt % of metal nanowires; and (a2) 0.01-16 wt % of micron metal flakes. A transparent conductive film manufactured from the transparent conductive film composite is also provided.

5 Claims, 2 Drawing Sheets

(56) References Cited

U.S. PATENT DOCUMENTS

| | | | | |
|---|---|---|---|---|
| 2013/0126796 | A1 | 5/2013 | Chung et al. | |
| 2013/0266795 | A1* | 10/2013 | Schultz | C09D 5/24 428/323 |
| 2014/0151607 | A1* | 6/2014 | Lowenthal | C09D 11/52 252/503 |
| 2015/0017457 | A1 | 1/2015 | Mizuno et al. | |

FOREIGN PATENT DOCUMENTS

| | | | |
|---|---|---|---|
| EP | 1922759 | B1 | 8/2012 |
| TW | 201322279 | A1 | 6/2013 |

OTHER PUBLICATIONS

Japanese Office Action for Appl. No. 2014-261734 dated Dec. 21, 2015 (w/ English translation).
Taiwan Office Action for Appl. No. 102148966 dated Mar. 2, 2015.
Hu et al., "Scalable Coating and Properties of Transparent, Flexible, Silver Nanowire Electrodes," ACS Nano, vol. 4, No. 5, 2010 (published online Apr. 28, 2010), pp. 2955-2963.
Lee et al., "Very long Ag nanowire synthesis and its application in a highly transparent, conductive and flexible metal electrode touch panel," Nanoscale, vol. 4, Aug. 7, 2012, pp. 6408-6414.
Madaria et al., "Large scale, highly conductive and patterned transparent films of silver nanowires on arbitrary substrates and their application in touch screens," Nanotechnology, vol. 22, Apr. 20, 2011, pp. 1-7.
Mayousse et al., "Improvements in purification of silver nanowires by decantation and fabrication of flexible transparent electrodes. Application to capacitive touch sensors," Nanotechnology, vol. 24, Apr. 25, 2013, pp. 1-6.
Zhu et al., "Transferable self-welding silver nanowire network as high performance transparent flexible electrode," Nanotechnology, vol. 24, Jul. 26, 2013, pp. 1-7.
Machine translation of CN-101805574-A published on Aug. 18, 2010.
Machine translation of CN-102399523-A published on Apr. 4, 2012.
Machine translation of CN-102676102-A published on Sep. 19, 2012.
Machine translation of JP-2012-518056-A published on Aug. 9, 2012.
Machine translation of JP-2013-38387-A published on Feb. 21, 2013.
Machine translation of JP-2013-517603-A published on May 16, 2013.
Machine translation of JP-5876618-B2 published on Mar. 2, 2016.
Machine translation of TW-201131582-A1 published on Sep. 16, 2011.
Machine translation of TW-201330011-A1 published on Jul. 16, 2013.

* cited by examiner

TRANSPARENT CONDUCTIVE FILM COMPOSITE AND TRANSPARENT CONDUCTIVE FILM

CROSS REFERENCE TO RELATED APPLICATIONS

This application claims priority of Taiwan Patent Application No. 102148966, filed on Dec. 30, 2013, the entirety of which is incorporated by reference herein.

BACKGROUND

Technical Field

The disclosure relates to a transparent conductive film, and in particular to a transparent conductive film composite and a transparent conductive film manufactured front the transparent conductive film composite.

Description of the Related Art

In recent years, the applications of the transparent conductive film increase and the demands of the transparent conductive film varied continuously. For example, electronic products such as liquid-crystal displays in flat display panels, electro luminescence panels, plasma display panels, field emission displays, touch panels, and solar cells, all utilize transparent conductive film as an electrode material. With the flourishing development of the 3C industry and the global trend of saving energy, the technology of the transparent conductive film becomes more and more important.

Therefore, a transparent conductive film which has high conductivity, high transparency and may be applied in flexible electronic products is needed.

SUMMARY

The present disclosure provides a transparent conductive film composite, including: (a) 0.07-0.2 wt % of a metallic material; (b) 0.01-0.5 wt % of a dispersant; and (c) 99.3-99.92 wt % of a solvent, wherein the metallic material (a) includes: (a1) 84-99.99 wt % of metal nanowires; and (a2) 0.01-16 wt % of micron metal flakes.

The present disclosure also provides a transparent conductive film, including: (a) a metallic material; and (b) a dispersant, wherein a weight ratio of the metallic material to the dispersant ranges from about 0.14:1 to 20:1, wherein the metallic material (a) includes: (a1) 84-99.99 wt % of metal nanowires; and (a2) 0.01-16 wt % of micron metal flakes, wherein a sheet resistance of the transparent conductive film is 100Ω/□ or less, and a transparency of the transparent conductive film is 95% or greater.

A detailed description is given in the following embodiments with reference to the accompanying drawings.

BRIEF DESCRIPTION OF THE DRAWINGS

The disclosure may be more fully understood by reading the subsequent detailed description and examples with references made to the accompanying drawings, wherein.

DETAILED DESCRIPTION

Figure 1A:
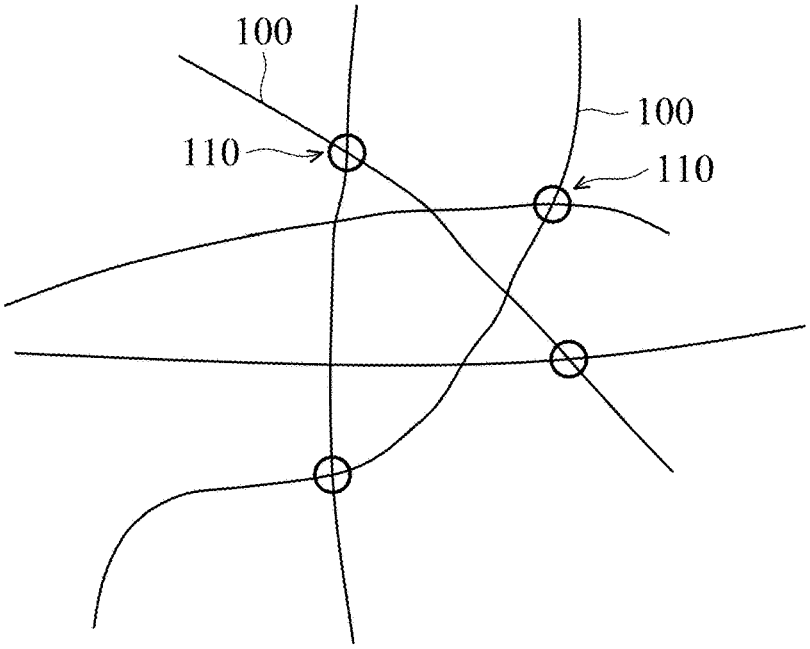
FIG. 1A is a schematic view of a transparent conductive film which only includes nano metal wires.

The transparent conductive film composite and the transparent conductive film of the present disclosure are described in the following detailed description. In the following detailed description, it should be noted that one or more embodiments are provided to illustrate the present application. The specific elements and configurations described in the following detailed description are merely used to clearly describe the present disclosure, and the scope of the present application is not intended to be limited by the specific element and configuration. In addition, various embodiments may use like reference numerals to clearly describe the present disclosure. However, the like reference numerals does not indicate a correlation between various embodiments and structures.

The terms "about" and "substantially" typically mean +/−20% of the stated value, more typically +/−10% of the stated value and even more typically +/−5% of the stated value. The stated value of the present disclosure is an approximate value. When there is no specific description, the stated value includes the meaning of "about" or "substantially".

Figure 1B:
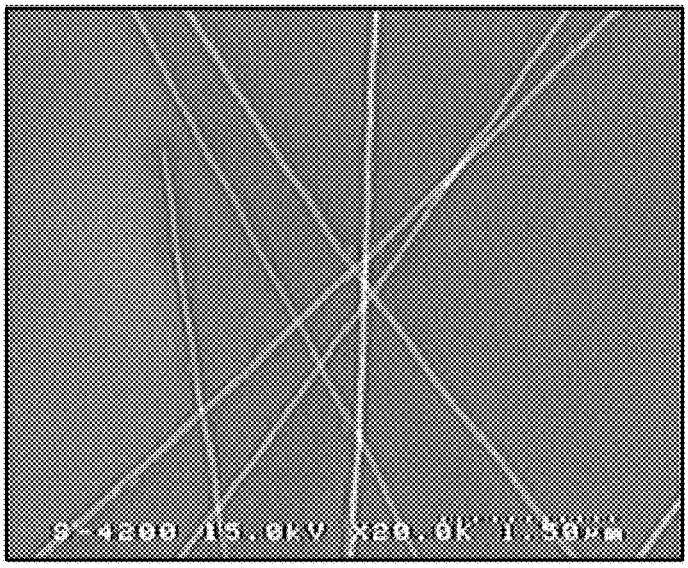
FIG. 1B is a microscopy image of a transparent conductive film which only includes nano metal wires.

FIG. 1A is a schematic view of a transparent conductive film which only includes nano metal wires, and FIG. 1B is a microscopy image of a transparent conductive film which only includes nano metal wires. According to FIGS. 1A and 1B, in the transparent conductive film containing only the metal nanowires 100, the metal nanowires 100 are electrically connected to each other to form conductive paths only through the contact points 110.

Figure 2A:
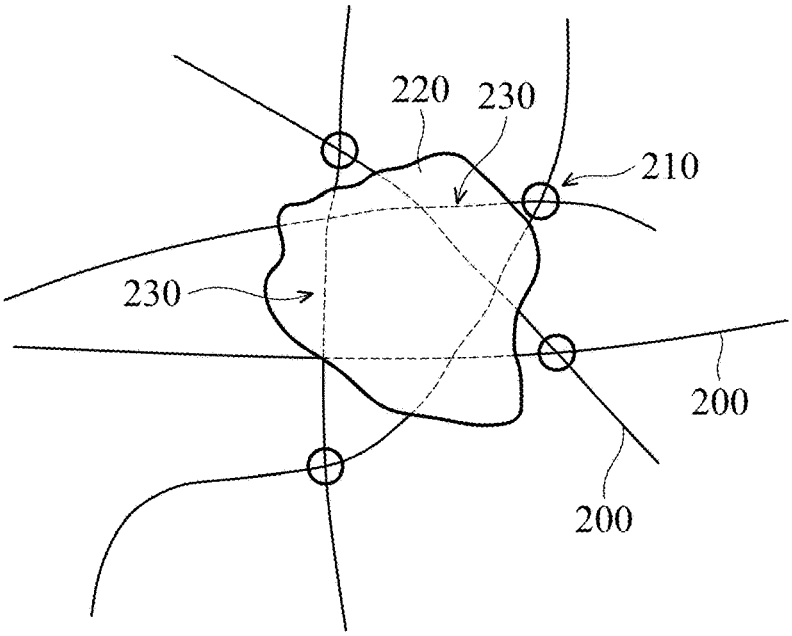
FIG. 2A is a schematic view of a transparent conductive film which includes metal nanowires and micron metal flakes.
Figure 2B:
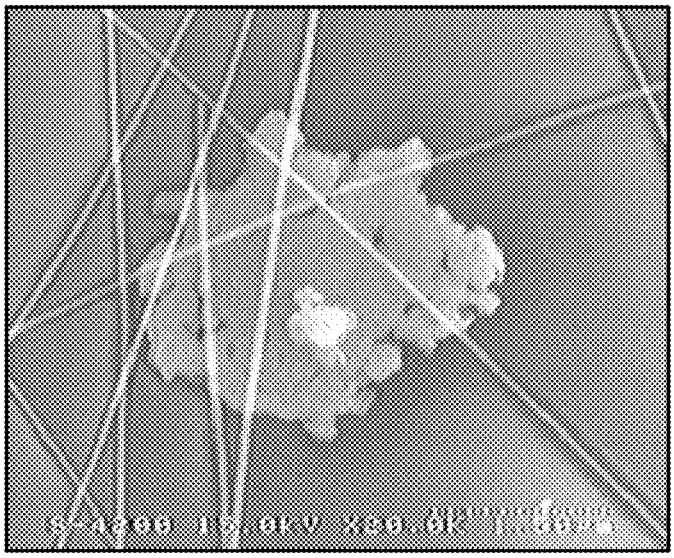
FIG. 2B is a microscopy image of a transparent conductive film which includes metal nanowires and micron metal flakes.

In the present disclosure, trace metal flakes are added into the transparent conductive film to enhance the conductivity of the transparent conductive film while maintaining its transparency. Referring to FIGS. 2A and 2B, FIG. 2A is a schematic view of a transparent conductive film which includes metal nanowires and micron metal flakes, and FIG. 2B is a microscopy image of a transparent conductive film which includes metal nanowires and micron metal flakes. As shown in the two figures, in the transparent conductive film containing metal nanowires 200 and micron metal flakes 220, the metal nanowires 200 may be electrically connected to each other to form a conductive path and enhance the conductivity not only through the contact point 210, but also through the contact region 230 of the metal nanowires 200 and the micron metal flakes 220. The manufacturing method and utilization of the transparent conductive film composite and the transparent conductive film in the embodiments of the present disclosure are described in the following detailed description.

First, a metallic material containing the nano metal wire and the macron metal flake is dispersed in a solvent by a dispersant to form the transparent conductive film composite. In one embodiment, excellent dispersion may be achieved by a three-roll mill. In the transparent conductive film composite, the total solid content of the nano metal wire and the micron metal flake ranges from about 0.07-0.2 wt %. In the metallic material, the weight ratio of the micron metal flake ranges from about 0.01-16 wt % based on the total solid content of the metallic material.

In particular, the transparent conductive film composite of the present disclosure may include about 0.07-0.2 wt % of the metallic; material, about 0.01-0.5 wt % of the dispersant;

and about 99.3-99.92 wt % of the solvent. For example, in one embodiment, the transparent conductive film composite of the present disclosure may include about 0.07-0.1 wt % of the metallic material, about 0.03-0.3 wt % of the dispersant; and about 99.6-99.90 wt % of the solvent.

The above metallic material may include the nano metal wire and the micron metal flake. The metallic material includes about 84-99.99 wt % of the nano metal wire and about 0.01-16 wt % of the micron metal flake. For example, in one embodiment, the metallic material includes about 90-99.9 wt % of the nano metal wire and about 0.1-10 wt % of the micron metal flake. In another embodiment, the metallic material includes about 99-99.9 wt % of the nano metal wire and about 0.1-1 wt % of the micron metal flake. In the present disclosure, since trace metal flakes are added into the transparent conductive film composite, the conductivity of the transparent conductive film manufactured from this transparent conductive film composite may be enhanced while maintaining its transparency.

In addition, it should be noted that if the metallic material in the transparent conductive film composite includes too many micron metal flakes, for example more than 16 wt % of the micron metal flake, the transparency of the subsequent transparent conductive film manufactured from this transparent conductive film composite may decrease, which in turn affects its applicability. On the other hand, if the metallic material in the transparent conductive film composite includes an insufficient quantity of micron metal flakes, for example less than 0.01 wt % of the micron metal flake, the conductivity of the subsequent transparent conductive film manufactured from this transparent conductive film composite cannot be effectively enhanced.

The material of the micron metal flake may be any flaky conductive material. The conductive paths between the one-dimensional metal nanowires may be increased through the two-dimensional shape of the micron metal flake. The material of the micron metal flake may include, but is not limited to, Au, Ag, Cu, an alloy thereof, a combination thereof, or any other suitable metal materials. The average flake size (D50) of the micron metal flake ranges from about 0.5 μm to 10 μm, for example from about 1 μm to 9 μm. In addition, the D90 flake size of the micron metal flake ranges from about 4 μm to 25 μm. It should be noted that if the flake size of the micron metal flake is too large, the transparency of the subsequent transparent conductive film may decrease. However, if the flake site of the micron metal flake is too small, the contact region of the micron metal flakes and the metal nanowires may be reduced, and the conductivity of the subsequent transparent conductive film cannot be effectively enhanced.

The nano metal wire may be any one-dimensional nano metal material. The nano metal wire is used to form the conductive paths in the transparent conductive film to make the transparent conductive film conductive. In addition, the nano metal wire may have nano size to maintain the transparency of the transparent conductive film. The material of the nano metal wire may include, but is not limited to, Au, Ag, Cu, an alloy thereof, a combination thereof, or any other suitable metal materials. The diameter of the nano metal wire range from about 15 nm to 100 nm, for example from about 20 nm to 80 nm. The aspect ratio of the nano metal wire may range from about 100 to 1000, for example from about 200 to 900. It should be noted that if the aspect ratio of the nano metal wire is too large, for example larger than about 1000, the nano metal wire is subject to breakage. However, if the aspect ratio of the nano metal wire is too small, for example smaller than about 100, the nano metal wire cannot effectively form the conductive paths due to its insufficient length, which in turn affects the conductivity of the transparent conductive film.

The dispersant is used to disperse the micron metal flake and the nano metal wire in the solvent. The dispersant has to disperse the micron metal flake and the nano metal wire uniformly to prevent the aggregation between the micron metal flake and the nano metal wire. In one embodiment, the dispersant may include, but is not limited to, methyl cellulose, carboxymethyl cellulose, ethyl cellulose, hydroxypropyl cellulose, polyvinylpyrrolidone, polyvinyl alcohol, a combination thereof, or any other suitable dispersant. The solvent may include, but is not limited to, water, alcohol (for example methanol, ethanol, or polyol), ketone, ether, a combination thereof, or any other suitable solvent.

Next, the transparent conductive film composite is coated on a substrate. Then the transparent conductive film composite is heat dried to form the transparent conductive film. The coating method may include, but is not limited to, wire rods coating, spin coating, print coating, or any other suitable coating methods. The print coating may include, but is not limited to, ink-jet printing, laser printing, slot coating, imprinting, gravure printing or screen printing. In addition, the heating duration of the heat drying step may be about 1 hour. The heating temperature of the heat drying step may be about 50° C.-150° C., for example about 70° C.-90° C.

The material of the substrate may include, but is not limited to, inorganic material such as glass or organic material such as plastic or synthetic resin. The plastic may include, but is not limited to, polyethylene terephthalate (PET), polyethylene (PE), polypropylene (PP), polycarbonate (PC), polystyrene (PS), polyacrylonitrile-butadiene-styrene (ABS) or any other suitable plastic. The synthetic resin may include, but is not limited to, phenolic resins, urea-formaldehyde resins, unsaturated polyester resins, melamine resins, urethane resins, alkyd resins, epoxy resins, polyvinyl acetate resins, polyacrylate resins, polyvinyl alcohol resins, petroleum resins, polyamide resins, furan resin, or marin anhydride resin.

The transparent conductive film includes about 40-96 wt % of the metallic material and 4-60 wt % of the dispersant. For example, in one embodiment, the transparent conductive film includes about 50-80 wt % of the metallic material and 20-50 wt % of the dispersant. In addition, the weight ratio of the metallic material to the dispersant ranges from about 0.14:1 to 20:1, for example from about 1:1 to 1.5:1. In the metallic material of the transparent conductive film, the ratio of the nano metal wire and the micron metal flake is substantially equal to that in the transparent conductive film composite. In other words, the metallic material in the transparent conductive film may include 84-99.99 wt % of the nano metal wire and 0.01-16 wt % of the micron metal flake. For example, the metallic material may include 90-99.9 wt % of the nano metal wire and 0.1-10 wt % of the micron metal flake.

Due to the trace of metal flake in the transparent conductive film in the present disclosure, the conductivity of the transparent conductive film array be enhanced while maintaining its transparency. For example, in one embodiment, the conductivity is enhanced by about 35% through the addition of the trace of metal flake. The sheet resistance of the transparent conductive film may be 100Ω/□ or less, for example 80Ω/□ or less. The transparency of the transparent conductive film may be 95% or greater, for example 98% or greater.

Since the present disclosure utilizes a simple drying step to dry the transparent conductive film composite to form the transparent conductive film, high-vacuum manufacturing equipment is not necessary. In addition, since the transparent conductive film of the present disclosure does not contain indium on (In) which has a high cost, the transparent conductive film of the present disclosure has a lower cost compared to the transparent conductive film manufactured from the indium tin oxide (ITO) material.

Furthermore, since the conductivity of the transparent conductive film of the present disclosure may be 101Ω/□ or less, the transparent conductive film may be applied to the medium-size and large-size display and panel. In addition, the transparent conductive film of the present disclosure is a flexible material, therefore it can be applied to flexible electronic products.

In summary, due to the trace of metal flakes in the transparent conductive film of the present disclosure, the conductivity of the transparent conductive film may be enhanced while maintaining its transparency. In addition, the transparent conductive film of the present disclosure is cost-effective, highly conductive, highly transparent and may be applied in flexible electronic products.

Below, exemplary embodiments will be described in detail for a more clear illustration of the present disclosure to a person having ordinary knowledge in the art.

EXAMPLE

Example 1

A water solution with 0.07625 wt % solid content of a nano silver was prepared from the nano silver wire with an average diameter ranging from about 60 nm to 70 nm and an average wire length ranging from about 30 μm to 40 μm (the average diameter was calculated by 12 nano silver wires observed by a transmission electron microscope and the average wire length was calculated by 30 nano silver wires observed by an optical microscope). The water solution contained 0.05 wt % of methyl cellulose. Another water solution with 0.25 wt % solid content of a silver flake (D50=1.57 μm) was prepared, which contained 1 wt % of methyl cellulose, 1 wt % of hydroxypropyl methylcellulose (HPMC), 2 wt % of polyvinylpyrrolidone (PVPK120, molecular weight: 2,540,000 to 3,220,000) and was dispersed by a three-roll mill. The above two solutions were mixed to prepare a transparent conductive film composite with $7.680\times10^{-2}$ wt % total solid content of silver (99 wt % of the nano silver wire and 1 wt % of a silver flake (D50=1.57 μm)). After the above two solutions were uniformly mixed, a washed glass sheet was prepared and preheated on a heater at 90° C. for 2 minutes. 500 μL of the prepared solution was pipetted by a micropipette and dropped onto the glass sheet. Subsequently, the solution was coated by a 25 μm wire rod and heated for 2 minutes on the heater. The physical characteristics of this transparent conductive film are shown in Table 1.

Example 2

A water solution with (1.07625 wt % solid content of a nano silver wire was prepared from the nano silver wire with an average diameter ranging from about 60 nm to 70 nm and an average wire length ranging from about 30 μm to 40 μm. The water solution contained 0.05 wt % of methyl cellulose. Another water solution with 0.25 wt % solid content of a silver flake (D50=1.57 μm) was prepared, which contained 1 wt % of methyl cellulose, 1 wt % of hydroxypropyl methylcellulose (HPMC), 2 wt % of polyvinylpyrrolidone (PVPK120, molecular weight: 2,540,000 to 3,220,000). The above two solutions were mixed to prepare a transparent conductive film composite with $7.779\times10^{-2}$ wt % total solid content of silver (97 wt % of the nano silver 3 wt % of a silver flake (D50=1.57 μm)). After the above two solutions were uniformly rained, a washed glass sheet was prepared and pretreated on a heater at 90° C. for 2 minutes. 500 μL of the prepared solution was pipetted by a micropipette and dropped onto the glass sheet. Subsequently, the solution was coated by a 25 μm wire rod and heated for 2 minutes on the heater. The physical characteristics of this transparent conductive film are shown in Table 1.

Example 3

A water solution with 0.07625 wt % solid content of a nano silver wire was prepared from the nano silver wire with an average diameter ranging from about 60 nm to 70 nm and an average wire length ranging from about 30 μm to 40 μm. The water solution contained 0.05 wt % of methyl cellulose. Another water solution with 0.25 wt % solid content of a silver flake (D50=1.57 μm) was prepared, which contained 1 wt % of methyl cellulose, 1 wt % of hydroxypropyl methylcellulose (HPMC), 2 wt % of polyvinylpyrrolidone (PVPK120, molecular weight: 2,540,000 to 3,220,000). The above two solutions were mixed to prepare a transparent conductive film composite with $7.894\times10^{-2}$ wt % total solid content of silver (95 wt % of the nano silver wire and 5 wt % of a silver flake (D50=1.57 μm)). After the above two solutions were uniformly mixed, a washed glass sheet was prepared and preheated on a heater at 90° C. for 2 minutes. 500 μL of the prepared solution was pipetted by a micropipette and dropped onto the glass sheet. Subsequently, the solution was coated by a 25 μm wire rod and heated for 2 minutes on the heater. The physical characteristics of this transparent conductive film are shown in Table 1.

Example 4

A water solution with 0.07625 wt % solid content of a nano silver was prepared from the nano silver wire with an average diameter ranging from about 60 nm to 70 nm and an average wire length ranging from about 30 μm to 40 μm. The water solution contained 0.05 wt % of methyl cellulose. Another water solution with 0.25 wt % solid content of a silver flake (D50=1.57 μm) was prepared, which contained 1 wt % of methyl cellulose, 1 wt % of hydroxypropyl methylcellulose (HPMC), 2 wt % of polyvinylpyrrolidone (PVPK120, molecular weight: 2,540,000 to 3,220,000) and was dispersed by a three-roll mill. The above two solutions were mixed to prepare a transparent conductive film composite with $7.999\times10^{-2}$ wt % total solid content of silver (93 wt % of the nano silver wire and 7 wt % of a silver flake (D50=1.57 μm)). After the above two solutions were uniformly mixed, a washed glass sheet was prepared and preheated on a heater at 90° C. for 2 minutes. 500 μL of the prepared solution was pipetted by a micropipette and dropped onto the glass sheet. Subsequently, the solution was coated by a 25 μm wire rod and heated for 2 minutes on the heater. The physical characteristics of this transparent conductive film are shown in Table 1.

Example 5

A water sol on with 0.07625 wt % solid content of a nano silver wire was prepared from the nano silver wire with an average diameter ranging front about 60 nm to 70 nm and an average wire length ranging from about 30 μm to 40 μm. The water solution contained 0.05 wt % of methyl cellulose, Another water solution with 0.25 wt % solid content of a silver flake (D50=1.57 μm) was prepared, which contained 1 wt % of methyl cellulose, 1 wt % of hydroxypropyl methylcellulose (HPMC), 2 wt % of polyvinylpyrrolidone (PVPK120, molecular weight: 2,540,000 to 3,220,000) and was dispersed by a three-roll mill. The above two solutions were mixed to prepare a transparent conductive film composite with $8.178\times10^{-2}$ wt % total solid content of silver (90 wt % of the nano silver wire and 10 wt % of a silver flake (D50=1.57 μm)). After the above two solutions were uniformly mixed, a washed glass sheet was prepared and preheated on a heater at 90° C. for 2 minutes. 500 μL of the prepared solution was pipetted by a micropipette and dropped onto the glass sheet. Subsequently, the solution was coated by a 25 μm wire rod and heated for 2 minutes on the heater. The physical characteristics of this transparent conductive film are shown in Table 1.

Example 6

A water solution with 0.07625 wt % solid content of a nano silver wire was prepared from the nano silver wire with an average diameter ranging from about 60 nm to 70 nm and an average wire length ranging from about 30 μm to 40 μm. The water solution contained 0.05 wt % of methyl cellulose. Another water solution with 0.25 wt % solid content of a silver flake (D50=1.57 μm) was prepared, which contained 1 wt % of methyl cellulose, 1 wt % of hydroxypropyl methylcellulose (HPMC), 2 wt % of polyvinylpyrrolidone (PVPK120, molecular weight: 2,540,000 to 3,220,000) and was dispersed by a three-roll mill. The above two solutions were mixed to prepare a transparent conductive film composite with $8.452\times10^{-2}$ wt % total solid content of silver (84 wt % of the nano silver wire and 16 wt % of a silver flake (D50=1.57 μm)). After the above two solutions were uniformly mixed, a washed glass sheet was prepared and preheated on a heater at 90° C. for 2 minutes. 500 μL of the prepared solution was pipetted by a micropipette and dropped onto the glass sheet. Subsequently, the solution was coated by a 25 μm wire rod and heated for 2 minutes on the heater. The physical characteristics of this transparent conductive film are shown in Table 1.

Example 7

A water solution with 0.07625 wt % solid content of a nano silver was prepared from the nano silver wire with an average diameter ranging from about 60 nm to 70 nm and an average wire length ranging from about 30 μm to 40 μm. The water solution contained 0.05 wt % of methyl cellulose. Another water solution with 0.25 wt % solid content of a silver flake (D50=2.5 μm) was prepared, which contained 1 wt % of methyl cellulose, 1 wt % of hydroxypropyl methylcellulose (HPMC), 2 wt % of polyvinylpyrrolidone (PVPK120, molecular weight: 2,540,000 to 3,220,000). The above two solutions were mixed to prepare a transparent conductive film composite with $7.680\times10^{-2}$ wt % total solid content of silver (99 wt % of the nano silver wire and 1 wt % of a silver flake (D50=2.5 μm)), After the above two solutions were uniformly mixed, a washed glass sheet was prepared and preheated on a heater at 90° C. for 2 minutes. 500 μL of the prepared solution was pipetted by a micropipette and dropped onto the glass sheet. Subsequently, the solution was coated by a 25 μm wire rod and heated for 2 minutes on the heater. The physical characteristics of this transparent conductive film are shown in Table 1.

Example 8

A water solution with 0.07625 wt % solid content of a nano silver wire was prepared from the nano silver wire with an average diameter ranging front about 60 nm to 70 nm and an average wire length ranging from about 30 μm to 40 μm. The water solution contained 0.05 wt % of methyl cellulose. Another water solution with 0.25 wt % solid content of a silver flake (D50=2.5 μm) was prepared, which contained 1 wt % of methyl cellulose. 1 wt % of hydroxypropyl methylcellulose (HPMC), 2 wt % of polyvinylpyrrolidone (PVPK120, molecular weight: 2,540,000 to 3,220,000). The above two solutions were mixed to prepare a transparent conductive film composite with $7.779\times10^{-2}$ wt % total solid content of silver (97 wt % of the nano silver wire and 3 wt % of a silver flake (D50=2.5 μm)). After the above two solutions were uniformly mixed, a washed glass sheet was prepared and preheated on a heater at 90° C. for 2 minutes. 500 μL of the prepared solution was pipetted by a micropipette and dropped onto the glass sheet. Subsequently, the solution was coated by a 25 μm wire rod and heated for 2 minutes on the heater. The physical characteristics of this transparent conductive film are shown in Table 1.

Example 9

A water solution with 0.07625 wt % solid content of a nano silver wire was prepared from the nano silver wire with an average diameter ranging from about 60 nm to 70 nm and an average wire length ranging from about 30 μm to 40 μm. The water solution contained 0.05 wt % of methyl cellulose. Another water solution with 0.25 wt % solid content of a silver flake (D50=2.5 μm) was prepared, which contained 1 wt % of methyl cellulose, 1% of hydroxypropyl methylcellulose (HPMC), 2 wt % of polyvinylpyrrolidone (PVPK120, molecular weight: 2,540,000 to 3,220,000). The above two solutions were mixed to prepare a transparent conductive film composite with $7.894\times10^{-2}$ wt % total solid content of silver (95 wt % of the nano silver wire and 5 wt % of a silver flake (D50=2.5 μm)). Alter the above two solutions were uniformly mixed, a washed glass sheet was prepared and preheated on a heater at 90° C. for 2 minutes, 500 μL of the prepared solution was pipetted by a micropipette and dropped onto the glass sheet. Subsequently, the solution was coated by a 25 μm wire rod and heated for 2 minutes on the heater. The physical characteristics of this transparent conductive film are shown in Table 1.

Example 10

A water solution with 0.07625 wt % solid content of a nano silver was prepared from the nano silver wire with an average diameter ranging from about 60 nm to 70 nm and an average wire length ranging from about 30 μm to 40 μm. The water solution contained 0.05 wt % of methyl cellulose. Another water solution with 0.25 wt % solid content of a silver flake (D50=2.5 μm) was prepared, which contained 1 wt % of methyl cellulose, 1 wt % of hydroxypropyl methylcellulose (HPMC) 2 wt % of polyvinylpyrrolidone (PVPK120, molecular weight: 2,540,000 to 3,220,000) and was dispersed by a three-roll mill. The above two solutions were mixed to prepare a transparent conductive film composite with $7.999\times10^{-2}$ wt % total solid content of silver (93 wt % of the nano silver wire and 7 wt % of a silver flake (D50=2.5 μm)). After the above two solutions were uniformly mixed, a washed glass sheet was prepared and preheated on a heater at 90° C., for 2 minutes. 500 μL of the prepared solution was pipetted by a micropipette and dropped onto the glass sheet. Subsequently, the solution was coated by a 25 μm wire rod and heated for 2 minutes on the heater. The physical characteristics of this transparent conductive film are shown in Table 1.

Example 11

A water solution with 0.07625 wt % solid content of a nano silver wire was prepared from the nano silver wire with an average diameter ranging from about 60 nm to 70 nm and an average length ranging from about 30 μm to 40 μm. The water solution contained 0.05 wt % of methyl cellulose. Another water solution with 0.25 wt % solid content of a silver flake (D50=2.5 μm) was prepared, which contained 1 wt % of methyl cellulose, 1 wt % of hydroxypropyl methylcellulose (HPMC), 2 wt % of polyvinylpyrrolidone (PVPK120, molecular weight: 2,540,000 to 3,220,000) and was dispersed by a three-roll mill. The above two solutions were mixed to prepare a transparent conductive film composite with $8.178\times10^{-2}$ wt % total solid content of silver (90 wt % of the nano silver wire and 10 wt % of a silver flake (D50=2.5 μm)). After the above two solutions were uniformly mixed, a washed glass sheet was prepared and preheated on a heater at 90° C. for 2 minutes. 500 μL of the prepared solution was pipetted by a micropipette and dropped onto the glass sheet. Subsequently, the solution was coated by a 25 μm wire rod and heated for 2 minutes on the heater. The physical characteristics of this transparent conductive film are shown in Table 1.

Example 12

A water solution with 0.07625 wt % solid content of a nano silver wire was prepared from the nano silver wire with an average diameter ranging from about 60 nm to 70 nm and an average wire length ranging from about 30 μm to 40 μm. The water solution contained 0.05 wt % of methyl cellulose. Another water solution with 0.25%, solid content of a silver flake (D50=2.5 μm) was prepared, which contained 1 wt % of methyl cellulose, 1 wt % of hydroxypropyl methylcellulose (HPMC), 2 wt % of polyvinylpyrrolidone (PVPK120, molecular weight: 2,540,000 to 3,220,000) and was dispersed by a three-roll mill. The above two solutions were mixed to prepare a transparent conductive film composite with $8.452\times10^{-2}$ wt % total solid content of silver (84 wt % of the nano silver wire and 16 wt % of a silver flake (D50=2.5 μm)). After the above two solutions were uniformly mixed, a washed glass sheet was prepared and preheated on a heater at 90° C. for 2 minutes. 500 μL of the prepared solution was pipetted by a micropipette and dropped onto the glass sheet. Subsequently, the solution was coated by a 25 μm wire rod and heated for 2 minutes on the heater. The physical characteristics of this transparent conductive film are shown in Table 1.

Example 13

A water solution with 0.07625 wt % solid content of a nano silver was prepared from the nano silver wire with an average diameter ranging from about 60 nm to 70 nm and an average wire length ranging from about 30 μm to 40 μm. The water solution contained 0.05 wt % of methyl cellulose. Another water solution with 0.25 wt % solid content of a silver flake (D50=4.63 μm) was prepared, which contained 1 wt % of methyl cellulose, 1 wt % of hydroxypropyl methylcellulose (HPMC), 2 wt % of polyvinylpyrrolidone (PVPK120, molecular weight: 2,540,000 to 3,220,000). The above two solutions were mixed to prepare a transparent conductive film composite with $7.894\times10^{-2}$ wt % total solid content of silver (95 wt % of the nano silver wire and 5 wt % of a silver flake (D50=4.63 μm)). After the above two solutions were uniformly mixed, a washed glass sheet was prepared and preheated on a heater at 90° C. for 2 minutes. 500 μL of the prepared solution was pipetted by a micropipette and dropped onto the glass sheet. Subsequently, the solution was coated by a 25 μm wire rod and heated for 2 minutes on the heater. The physical characteristics of this transparent conductive film are shown in Table 1.

Example 14

A water solution with 0.07625 wt % solid content of a nano silver wire was prepared from the nano silver wire with an average diameter ranging from about 60 nm to 70 nm and an average wire length ranging from about 30 μm to 40 μm. The water solution contained 0.05 wt % of methyl cellulose. Another water solution with 0.25 wt % solid content of a silver flake (D50=4.63 μm) was prepared, which contained 1 wt % of methyl cellulose, 1 wt % of hydroxypropyl methylcellulose (HPMC), 2 wt % of polyvinylpyrrolidone (PVPK120, molecular weight: 2,540,000 to 3,220,000) and was dispersed by a three-roll mill. The above two solutions were mixed to prepare a transparent conductive film composite with $8.178\times10^{-2}$ wt % total solid content of silver (90 wt % of the nano silver wire and 10 wt % of a silver flake (D50=4.63 μm)). After the above two solutions were uniformly mixed, a washed glass sheet was prepared and preheated on a heater at 90° C. for 2 minutes 500 μL of the prepared solution was pipetted by a micropipette and dropped onto the glass sheet. Subsequently, the solution was coated by a 25 μm wire rod and heated for 2 minutes on the heater. The physical characteristics of this transparent conductive film are shown in Table 1.

Example 15

A water solution with 0.07625 wt % solid content of a nano silver was prepared from the nano silver wire with an average diameter ranging from about 60 nm to 70 nm and an average wire length ranging from about 30 μm to 40 μm. The water solution contained 0.05 wt % methyl cellulose. Another water solution with 0.25 wt % solid content of a silver flake (D50=4.63 μm) was prepared, which contained 1 wt % of methyl cellulose, 1 wt % of hydroxy propyl methylcellulose (HPMC), 2 wt % of polyvinylpyrrolidone (PVPK120, molecular weight: 2,540,000 to 3,220,000) and was dispersed by a three-roll mill. The above two solutions were mixed to prepare a transparent conductive film composite with $8.452\times10^{-2}$ wt % total solid content of silver (84 wt % of the nano silver wire and 16 wt % of a silver flake (D50=4.63 μm)). After the above two solutions were uniformly mixed, a washed glass sheet was prepared and preheated on a heater at 90° C. for 2 minutes. 500 μL of the prepared solution was pipetted by a micropipette and dropped onto the glass sheet. Subsequently, the solution was coated by a 25 μm wire rod and heated for 2 minutes on the heater. The physical characteristics of this transparent conductive film are shown in Table 1.

Example 16

A water solution with 0.07625 wt % solid content of a nano silver wire was prepared from the nano silver wire with an average diameter ranging from about 60 nm to 70 nm and an average wire length ranging from about 30 μm to 40 μm. The water solution contained 0.05 wt % of methyl cellulose. Another water solution with 0.25 wt % solid content of a silver flake (D50=8.38 μm) was prepared, which contained 1 wt % of methyl cellulose, 1 wt % of hydroxypropyl methylcellulose (HPMC), 2 wt % of polyvinylpyrrolidone (PVPK120, molecular weight: 2,540,000 to 3,220,000). The above two solutions were mixed to prepare a transparent conductive film composite with $7.894\times10^{-2}$ wt % total solid content of silver (95 wt % of the nano silver wire and 5 wt % of a silver flake (D50=8.38 μm)). After the above two solutions were uniformly mixed, a washed glass sheet was prepared and preheated on a heater at 90° C. for 2 minutes. 500 μL of the prepared solution was pipetted by a micropipette and dropped onto the glass sheet. Subsequently, the solution was coated by a 25 μm wire rod and heated for 2 minutes on the heater. The physical characteristics of this transparent conductive film are shown in Table 1.

Example 17

A water solution with 0.07625 wt % solid content of a nano silver wire was prepared from the nano silver wire with an average diameter ranging from about 60 nm to 70 nm and an average wire length ranging from about 30 μm to 40 μm. The water solution contained 0.05 wt % of methyl cellulose. Another water solution with 0.25 wt % solid content of a silver flake (D50=8.38 μm) was prepared, which contained 1 wt % of methyl cellulose, 1 wt % of hydroxypropyl methylcellulose (HPMC), 2 wt % of polyvinylpyrrolidone (PVPK120, molecular weight: 2,540,000 to 3,220,000) and was dispersed by a three-roll mill. The above two solutions were mixed to prepare a transparent conductive film composite with $8.178\times10^{-2}$ wt % total solid content of silver (90 wt % of the nano silver wire and 10 wt % of a silver flake (D50=8.38 μm)). After the above two solutions were uniformly mixed, a washed glass sheet was prepared and preheated on a heater at 90° C. for 2 minutes 500 μL of the prepared solution was pipetted by a micropipette and dropped onto the glass sheet. Subsequently, the solution was coated by a 25 μm wire rod and heated for 2 minutes on the heater. The physical characteristics of this transparent conductive film are shown in Table 1.

Example 18

A water solution with 0.07625 wt % solid content of a nano silver was prepared from the nano silver wire with an average diameter ranging from about 60 nm to 70 nm and an average wire length ranging from about 30 μm to 40 μm. The water solution contained 0.05 wt % of methyl cellulose. Another water solution with 0.25 wt % solid content of a silver flake (D50=8.38 μm) was prepared, which contained 1 wt % of methyl cellulose, 1 wt % of hydroxypropyl methylcellulose (HPMC), 2 wt % of polyvinylpyrrolidone; (PVPK120, molecular weight: 2,540,000 to 3,220,000) and was dispersed by a three-roll mill. The above two solutions were mixed to prepare a transparent conductive film composite with $8.452\times10^{-2}$ wt % total solid content of silver (84 wt % of the nano silver wire and 16 wt % of a silver flake (D50=8.38 μm)). After the above two solutions were uniformly mixed, a washed glass sheet was prepared and preheated on a heater at 90° C. for 2 minutes. 500 μL of the prepared solution was pipetted by a micropipette and dropped onto the glass sheet. Subsequently, the solution was coated by a 25 μm wire rod and heated for 2 minutes on the heater. The physical characteristics of this transparent conductive film are shown in Table 1.

Comparative Example 1

A water sol on with 0.07625 wt % solid content of a nano silver wire was prepared from the nano silver wire with an average diameter ranging from about 60 nm to 70 nm and an average wire length ranging from about 30 μm to 40 μm. The water solution contained 0.05 wt % of methyl cellulose. The above solution was used to prepare a transparent conductive film composite with $7.680\times10^{-2}$ wt % total solid content of silver, which contained 100 wt % of the nano silver wire. Then a washed glass sheet was prepared and preheated on a heater at 90° C. for 2 minutes. 500 μL of the prepared solution was pipetted by a micropipette and dropped onto the glass sheet. Subsequently, the solution was coated by a 25 μm wire rod and heated for 2 minutes on the heater. The physical characteristics of this transparent conductive film are shown in Table 1.

Comparative Example 2

A water solution with 0.07625 wt % solid content of a nano silver wire was prepared from the nano silver wire with an average diameter ranging from about 60 nm to 70 nm and an average wire length ranging from about 30 μm to 40 μm. The water solution contained 0.05 wt % of methyl cellulose. The above solution was used to prepare a transparent conductive film composite with $7.779\times10^{-2}$ wt % total solid content of silver, which contained 100 wt % of the nano silver wire. Then a washed glass sheet was prepared and preheated on a heater at 90° C. for 2 minutes. 500 μL of the prepared solution was pipetted by a micropipette and dropped onto the glass sheet. Subsequently, the solution was coated by a 25 μm wire rod and heated for 2 minutes on the heater. The physical characteristics of this transparent conductive film are shown in Table 1.

Comparative Example 3

A water solution with 0.07625 wt % solid content of a nano silver wire was prepared from the nano silver wire with an average diameter ranging from about 60 nm to 70 nm and an average wire length ranging from about 30 μm to 40 μm. The water solution contained 0.05 wt % of methyl cellulose. The above solution was used to prepare a transparent conductive film composite with $7.894\times10^{-2}$ wt % total solid content of silver, which contained 100 wt % of the nano silver wire. Then a washed glass sheet was prepared and preheated on a heater at 90° C. for 2 minutes. 500 μL of the prepared solution was pipetted by a micropipette and dropped onto the glass sheet. Subsequently, the solution was coated by a 25 μm wire rod and heated for 2 minutes on the heater. The physical characteristics of this transparent conductive film are shown in Table 1.

Comparative Example 4

A water solution with 0.07625 wt % solid content of a nano silver was prepared from the nano silver wire with an average diameter ranging from about 60 nm to 70 nm and an average wire length ranging from about 30 μm to 40 μm. The water solution contained 0.05 wt % of methyl cellulose. The above solution was used to prepare a transparent conductive film composite with $7.999\times10^{-2}$ wt % total solid content of silver, which contained 100 wt % of the nano silver wire.

Then a washed glass sheet was prepared and preheated on a heater at 90° C. for 2 minutes, 500 μL of the prepared solution was pipetted by a micropipette and dropped onto the glass sheet. Subsequently, the solution was coated by a 25 μm wire rod and heated for 2 minutes on the heater. The physical characteristics of this transparent conductive film are shown in Table 1.

Comparative Example 5

A water solution with 0.07625 wt % solid content of a nano silver wire was prepared from the nano silver wire with an average diameter ranging front about 60 nm to 70 nm and an average wire length ranging from about 30 μm to 40 μm. The water solution contained 0.05 wt % of methyl cellulose. The above solution was used to prepare a transparent conductive film composite with $8.178\times10^{-2}$ wt % total solid content of silver, which contained 100 wt % of the nano silver wire. Then a washed glass sheet was prepared and preheated on a heater at 90° C. for 2 minutes. 500 μL of the prepared solution was pipetted by a micropipette and dropped onto the glass sheet. Subsequently, the solution was coated by a 25 μm wire rod and heated for 2 minutes on the heater. The physical characteristics of this transparent conductive filer are shown in Table 1.

Comparative Example 6

A water solution with 0.07625 wt % solid content of a nano silver was prepared from the nano silver wire with an average diameter ranging from about 60 nm to 70 nm and an average wire length ranging from about 30 μm to 40 μm. The water solution contained 0.05 wt % of methyl cellulose. The above solution was used to prepare a transparent conductive film composite with $8.452\times10^{-2}$ wt % total solid content of silver, which contained 100 wt % of the nano silver wire. Then a washed glass sheet was prepared and preheated on a heater at 90° C. for 2 minutes, 500 μL of the prepared solution was pipetted by a micropipette and dropped onto the glass sheet. Subsequently, the solution was coated by a 25 μm wire rod and heated for 2 minutes on the heater. The physical characteristics of this transparent conductive film are shown in Table 1.

Comparative Example 7

A water solution with 0.07625 wt % solid content of a nano silver wire was prepared from the nano silver wire with an average diameter ranging from about 60 nm to 70 nm and an average wire length ranging from about 30 μm to 40 μm. The water solution contained 0.05 wt % of methyl cellulose. The above solution was used to prepare a transparent conductive film composite with $7.625\times10^{-2}$ wt % total solid content of silver, which contained 100 wt % of the nano silver wire. Then a washed glass sheet was prepared and preheated on a heater at 90° C. for 2 minutes. 500 μL of the prepared solution was pipetted by a micropipette and dropped onto the glass sheet. Subsequently, the solution was coated by a 25 μm wire rod and heated for 2 minutes on the heater. The physical characteristics of this transparent conductive film are shown in Table 1.

Comparative Example 8

A water solution with 3 wt % solid content of a silver flake (D50=1.57 μm) was prepared, which contained 1 wt % of methyl cellulose, 1 wt % of hydroxypropyl methylcellulose (HPMC), 2 wt % of polyvinylpyrrolidone (PVPK120, molecular weight: 2,540,000 to 3,220,000) and was dispersed by a three-roll mill. The above solution was used to prepare a transparent conductive film composite with $300\times10^{-2}$ wt % total solid content of silver, which contained 100 wt % of a silver flake (D50=1.57 μm). After the solution was uniformly mixed, a washed glass sheet was prepared and preheated on a heater at 90° C. for 2 minutes. 500 μL of the prepared solution was pipetted by a micropipette and dropped onto the glass sheet. Subsequently, the solution was coated by a 25 μm wire rod and heated for 2 minutes on the heater. The physical characteristics of this transparent conductive film are shown in Table 1.

TABLE 1

Composition and physical characteristics of the transparent conductive films

| | Silver solid content ($\times10^{-2}$ wt %) | nano silver wire (wt %) | silver flake (wt %) | silver flake size D50 (μm) | silver flake size D90 (μm) | dispersant ($\times10^{-2}$ wt %) | sheet resistance (Ω/□) | transparency (T %) |
|---|---|---|---|---|---|---|---|---|
| Example 1 | 7.680 | 99 | 1 | 1.57 | 4.74 | 6.2 | 87 | 98.452 |
| Example 2 | 7.779 | 97 | 3 | 1.57 | 4.74 | 8.7 | 75 | 98.259 |
| Example 3 | 7.894 | 95 | 5 | 1.57 | 4.74 | 11.1 | 55 | 98.466 |
| Example 4 | 7.999 | 93 | 7 | 1.57 | 4.74 | 13.5 | 56 | 98.006 |
| Example 5 | 8.178 | 90 | 10 | 1.57 | 4.74 | 17 | 47 | 98.400 |
| Example 6 | 8.452 | 84 | 16 | 1.57 | 4.74 | 23.8 | 47 | 97.289 |
| Example 7 | 7.680 | 99 | 1 | 2.5 | 4.3 | 6.2 | 82 | 98.389 |
| Example 8 | 7.779 | 97 | 3 | 2.5 | 4.3 | 8.7 | 64 | 98.308 |
| Example 9 | 7.894 | 95 | 5 | 2.5 | 4.3 | 11.1 | 62 | 98.256 |
| Example 10 | 7.999 | 93 | 7 | 2.5 | 4.3 | 13.5 | 64 | 98.319 |
| Example 11 | 8.178 | 90 | 10 | 2.5 | 4.3 | 17 | 64 | 98.255 |
| Example 12 | 8.452 | 84 | 16 | 2.5 | 4.3 | 23.8 | 35 | 96.525 |
| Example 13 | 7.894 | 95 | 5 | 4.63 | 10.57 | 6.2 | 62 | 97.460 |
| Example 14 | 8.178 | 90 | 10 | 4.63 | 10.57 | 11.1 | 60 | 97.494 |
| Example 15 | 8.452 | 84 | 16 | 4.63 | 10.57 | 23.8 | 48 | 96.900 |
| Example 16 | 7.894 | 95 | 5 | 8.38 | 23.75 | 6.2 | 57 | 97.207 |
| Example 17 | 8.178 | 90 | 10 | 8.38 | 23.75 | 11.1 | 59 | 96.995 |
| Example 18 | 8.452 | 84 | 16 | 8.38 | 23.75 | 23.8 | 45 | 95.536 |
| Comparative example 1 | 7.680 | 100 | 0 | X | X | X | 114 | 98.475 |

TABLE 1-continued

Composition and physical characteristics of the transparent conductive films

| | Silver solid content ($\times 10^{-2}$ wt %) | nano silver wire (wt %) | silver flake (wt %) | silver flake size D50 (μm) | silver flake size D90 (μm) | dispersant ($\times 10^{-2}$ wt %) | sheet resistance (Ω/□) | transparency (T %) |
|---|---|---|---|---|---|---|---|---|
| Comparative example 2 | 7.779 | 100 | 0 | X | X | 5 | 101 | 98.526 |
| Comparative example 3 | 7.894 | 100 | 0 | X | X | 5 | 90 | 98.525 |
| Comparative example 4 | 7.999 | 100 | 0 | X | X | 5 | 74 | 98.248 |
| Comparative example 5 | 8.178 | 100 | 0 | X | X | 5 | 72 | 98.160 |
| Comparative example 6 | 8.452 | 100 | 0 | X | X | 5 | 52 | 97.941 |
| Comparative example 7 | 7.625 | 100 | 0 | X | X | 5 | 157 | 99.058 |
| Comparative example 8 | 300 | 0 | 100 | 1.57 | 4.74 | 400 | X | 82.749 |

Table 1 shows the composition and physical characteristics of the transparent conductive films of examples 1-18 and comparative examples 1-8. According to table 1, for the same metal solid content, the transparent conductive film which contained silver flakes had good conductivity. For example, all of the silver solid content of the transparent conductive films in examples 1, 7 and comparative example 1 were $7.680\times10^{-2}$ wt %, and the sheet resistance of the transparent conductive films containing trace of silver flakes in examples 1, 7 (87Ω/□ and 82Ω/□) was explicitly less than the sheet resistance of the transparent conductive film without the silver flakes in comparative example 1 (114Ω/□). In addition, the transparency of the transparent conductive films in examples 1, 7 (98.452% and 98.389%) as substantially equal to the transparency of the transparent conductive film in comparative example 1 (98.475%). Therefore, adding a specific amount of the micron metal flake into the transparent conductive film could explicitly enhance the conductivity of the transparent conductive film without sacrificing its transparency. For example, the conductivity of the transparent conductive film in comparative example 3 was 90Ω/□, while the conductivity of the transparent conductive film containing 5 wt % of the silver flakes in the corresponding example 3 was 55Ω/□. The conductivity was enhanced impressively by 38%. The same trend was shown in other examples.

In addition, the D50 flake size of the micron metal flakes in examples 1-6 was 1.57 μm. The D50 flake size of the micron metal flakes in examples 7-12 was 2.5 μm. The D50 flake size of the micron metal flakes in examples 13-15 was 4.63 μm. The D50 flake size of the micron metal flakes in examples 16-18 was 8.38 μm. According to examples 1-18 in Table 1, as the D50 flake size of the micron metal flake increased, the sheet resistance of the transparent conductive film decreased. However, the micron metal flake with larger D50 flake size would also decrease the transparency of the transparent conductive film. For example, both of the silver solid contents of the transparent conductive films in examples 1, 7 were $7.680\times10^{-2}$ wt %, and both of the silver solid contents included 99 wt % of the nano silver wire and 1 wt % of the silver flake. Since the D50 flake size of the micron metal flake in example 1 (1.57 μm) was smaller than the D50 flake site of the micron metal flake in example 7 (2.5 μm), the sheet resistance of the transparent conductive film in example 1 (87Ω/□) was greater than the sheet resistance of the transparent conductive film in example 7 (82Ω/□). In addition, since the micron metal flake in example 1 had a smaller D50 flake size, the transparency of the transparent conductive film in example 1 was greater. In particular, the transparency of the transparent conductive film in example 1 (98.452%) was slightly greater than the transparency of the transparent conductive film in example 7 (98.389%). In addition, according to the comparative example 8, the transparent conductive film containing only the silver flake did not have conductivity and had a poor transparency (82.749%). It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A transparent conductive film, consisting of:

(a) a metallic material; and (b) a dispersant, wherein a weight ratio of the metallic material to the dispersant ranges from 0.14:1 to 20:1, wherein the metallic material (a) comprises:

(a1) 84-99.99 wt % of metal nanowires; and (a2) 0.01-16 wt % of micron metal flakes, wherein a sheet resistance of the transparent conductive film is 10052/or less, and a transparency of the transparent conductive film is 95% or greater.

2. The transparent conductive film as claimed in claim 1, wherein the micron metal flake and the nano metal wire each independently comprises: Au, Ag, Cu, an alloy thereof, or a combination thereof.

3. The transparent conductive film as claimed in claim 1, wherein an average flake size (D50) of the micron metal flake ranges from 0.5 μm to 10 μm.

4. The transparent conductive film as claimed in claim 1, wherein an aspect ratio of the nano metal wire ranges from 100 to 1000.

5. The transparent conductive film as claimed in claim 1, wherein the dispersant comprises methyl cellulose, carboxymethyl cellulose, ethyl cellulose, hydroxypropyl cellulose, polyvinylpyrrolidone, polyvinyl alcohol, or a combination thereof.

* * * * *